US006327834B1

(12) United States Patent
Northway, Sr.

(10) Patent No.: US 6,327,834 B1
(45) Date of Patent: Dec. 11, 2001

(54) SHINGLE ROOFING AND REMOVING SYSTEM

(76) Inventor: Jack R. Northway, Sr., 1412 Alpha Ave., Des Moines, IA (US) 50316

( * ) Notice: Subject to any disclaimer, the term of this patent is extended or adjusted under 35 U.S.C. 154(b) by 0 days.

(21) Appl. No.: 09/572,881

(22) Filed: May 19, 2000

(51) Int. Cl.[7] ..... E04D 15/00

(52) U.S. Cl. ..... 52/749.12; 52/748.11; 52/749.1

(58) Field of Search ..... 52/749.12, 478, 52/518, 749.1, 478.11

(56) References Cited

U.S. PATENT DOCUMENTS

| | | | |
|---|---|---|---|
| D. 293,039 | | 12/1987 | Beattie . |
| 1,642,088 | | 9/1927 | Scarff . |
| 3,875,715 | | 4/1975 | Martin et al. . |
| 4,113,907 | * | 9/1978 | Haage et al. ..... 428/111 |
| 4,671,036 | | 6/1987 | Sullivan . |
| 5,570,553 | | 11/1996 | Balkins . |
| 5,623,802 | | 4/1997 | Boushek et al. . |
| 5,687,539 | | 11/1997 | Bond . |
| 6,125,720 | * | 10/2000 | Gohman ..... 81/45 |

* cited by examiner

*Primary Examiner*—Beth A. Stephan
*Assistant Examiner*—Dennis L. Dorsey

(57) ABSTRACT

A shingle roofing and removing system for easily removing the shingles from a roof when needed. The shingle roofing and removing system includes sheeting material adapted to be securely attached upon a roof from a bottom edge to a top thereof and being adapted to be disposed beneath shingles which are securely attached to the sheeting material; and also includes a sheeting material removal assembly for removing the sheeting material along with the shingles from the roof.

12 Claims, 4 Drawing Sheets

SHINGLE ROOFING AND REMOVING SYSTEM

BACKGROUND OF THE INVENTION

1. Field of the Invention

The present invention relates to a shingle attaching and removing system and more particularly pertains to a new shingle roofing and removing system for easily removing the shingles from a roof when needed.

2. Description of the Prior Art

The use of a shingle attaching and removing system is known in the prior art. More specifically, a shingle attaching and removing system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,687,539 5,570, 553; 1,642,088; U.S. Pat. No. Des. 293,039; U.S. Pat. Nos. 4,671,036; and 5,623,802.

While these devices fulfill their respective, particular objectives and requirements, the aforementioned patents do not disclose a new shingle roofing and removing system. The inventive device includes sheeting material adapted to be securely attached upon a roof from a bottom edge to a top thereof and being adapted to be disposed beneath shingles which are securely attached to the sheeting material; and also includes a sheeting material removal assembly for removing the sheeting material along with the shingles from the roof.

In these respects, the shingle roofing and removing system according to the present invention substantially departs from the conventional concepts and designs of the prior art, and in so doing provides an apparatus primarily developed for the purpose of easily removing the shingles from a roof when needed.

SUMMARY OF THE INVENTION

In view of the foregoing disadvantages inherent in the known types of shingle attaching and removing system now present in the prior art, the present invention provides a new shingle roofing and removing system construction wherein the same can be utilized for easily removing the shingles from a roof when needed.

The general purpose of the present invention, which will be described subsequently in greater detail, is to provide a new shingle roofing and removing system which has many of the advantages of the shingle attaching and removing system mentioned heretofore and many novel features that result in a new shingle roofing and removing system which is not anticipated, rendered obvious, suggested, or even implied by any of the prior art shingle attaching and removing system, either alone or in any combination thereof.

To attain this, the present invention generally comprises sheeting material adapted to be securely attached upon a roof from a bottom edge to a top thereof and being adapted to be disposed beneath shingles which are securely attached to the sheeting material; and also includes a sheeting material removal assembly for removing the sheeting material along with the shingles from the roof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shingle roofing and removing system which has many of the advantages of the shingle attaching and removing system mentioned heretofore and many novel features that result in a new shingle roofing and removing system which is not anticipated, rendered obvious, suggested, or even implied by any of the prior art shingle attaching and removing system, either alone or in any combination thereof.

It is another object of the present invention to provide a new shingle roofing and removing system which may be easily and efficiently manufactured and marketed.

It is a further object of the present invention to provide a new shingle roofing and removing system which is of a durable and reliable construction.

An even further object of the present invention is to provide a new shingle roofing and removing system which is susceptible of a low cost of manufacture with regard to both materials and labor, and which accordingly is then susceptible of low prices of sale to the consuming public, thereby making such shingle roofing and removing, system economically available to the buying public.

Still yet another object of the present invention is to provide a new shingle roofing and removing system which provides in the apparatuses and methods of the prior art some of the advantages thereof, while simultaneously overcoming some of the disadvantages normally associated therewith.

Still another object of the present invention is to provide a new shingle roofing and removing system for easily removing the shingles from a roof when needed.

Yet another object of the present invention is to provide a new shingle roofing and removing system which includes sheeting material adapted to be securely attached upon a roof from a bottom edge to a top thereof and being adapted to be disposed beneath shingles which are securely attached to the sheeting material; and also includes a sheeting material removal assembly for removing the sheeting material along with the shingles from the roof.

Still yet another object of the present invention is to provide a new shingle roofing and removing system that quickly and convenient removes shingles from a roof.

Even still another object of the present invention is to provide a new shingle roofing and removing system that saves the user substantial time in replacing shingles on a roof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
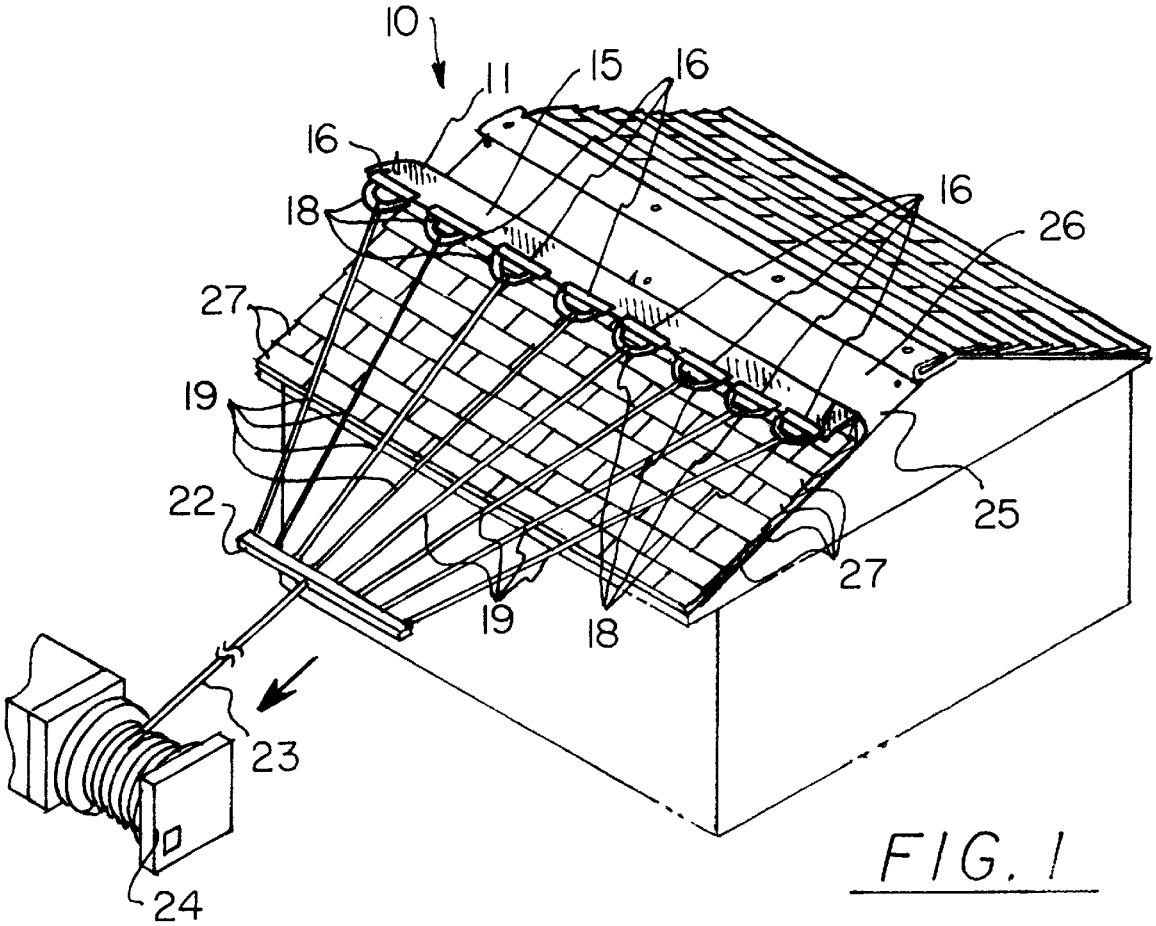
FIG. 1 is a perspective view of a new shingle roofing and removing system according to the present invention shown in use.
Figure 2:
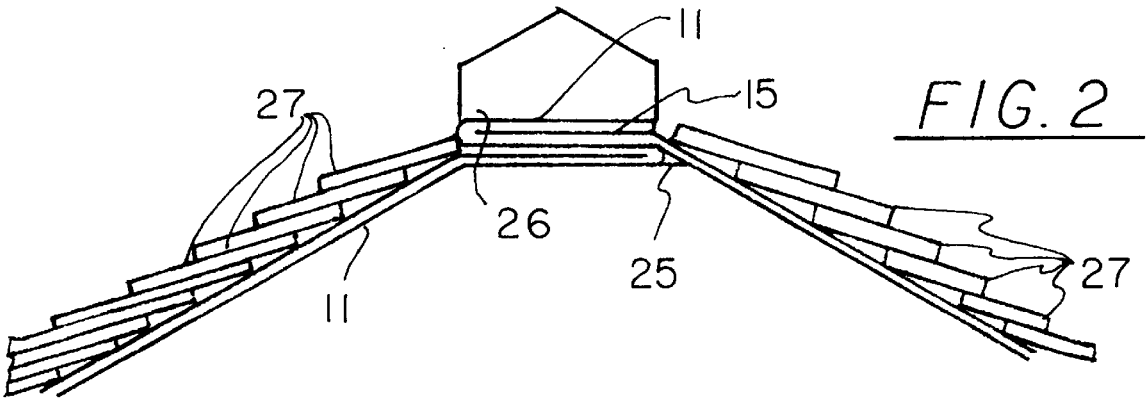
FIG. 2 is an end elevational view of the present invention.
Figure 3:
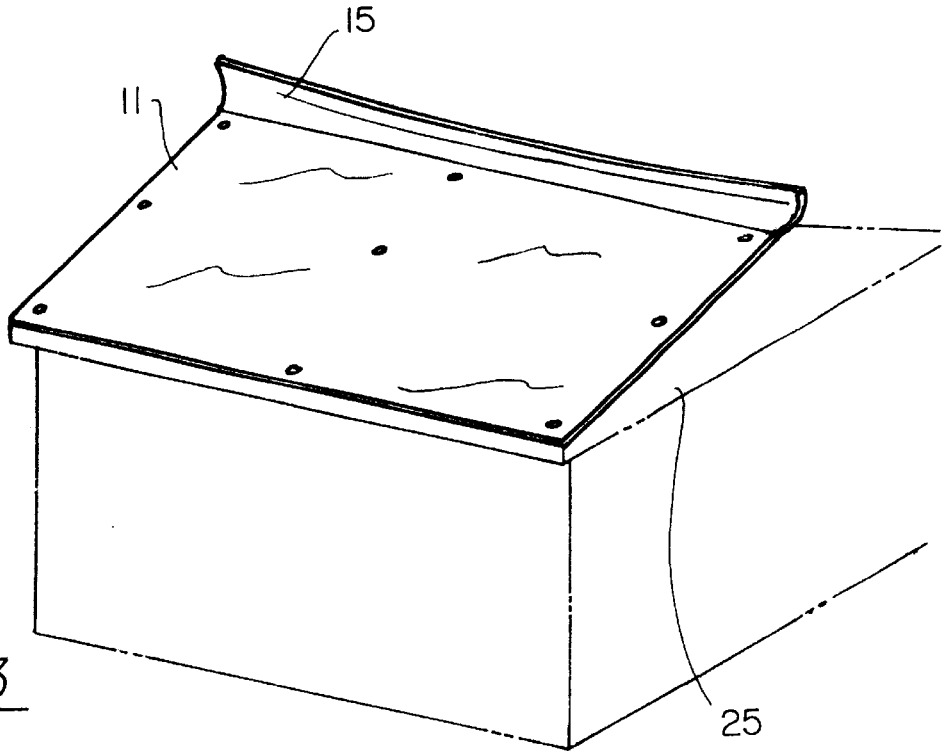
FIG. 3 is a perspective view of the sheeting material of the present invention being placed upon a roof.
Figure 4:
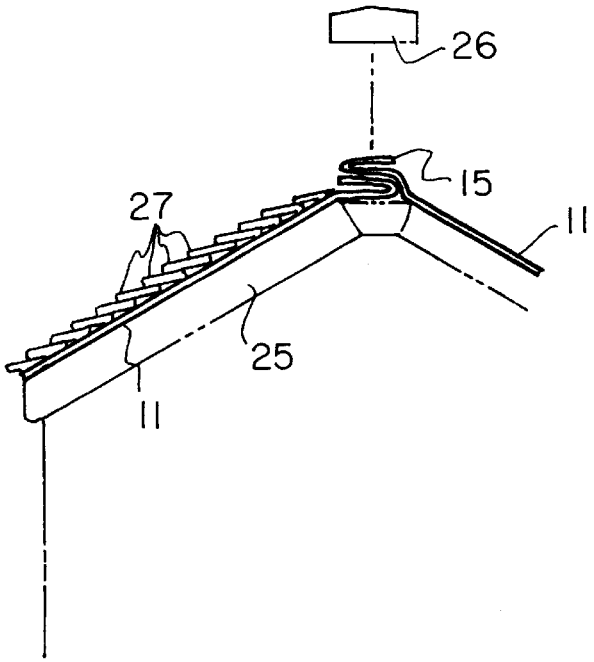
FIG. 4 is an end elevational view of the present invention.
Figure 5:
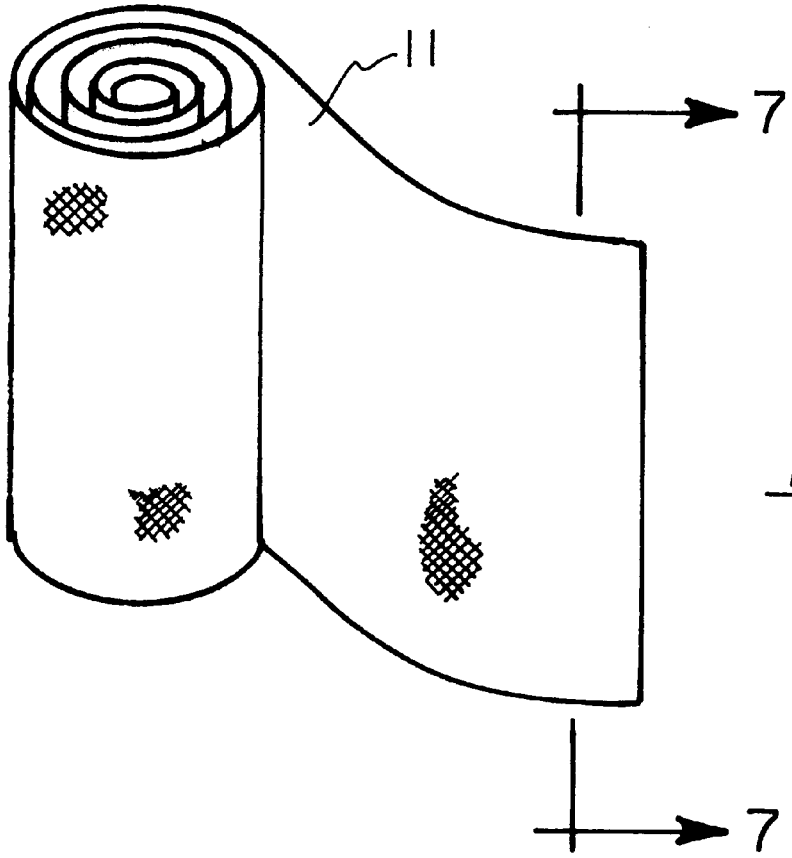
FIG. 5 is a perspective view of the rolled-up sheeting material of the present invention.
Figure 6:
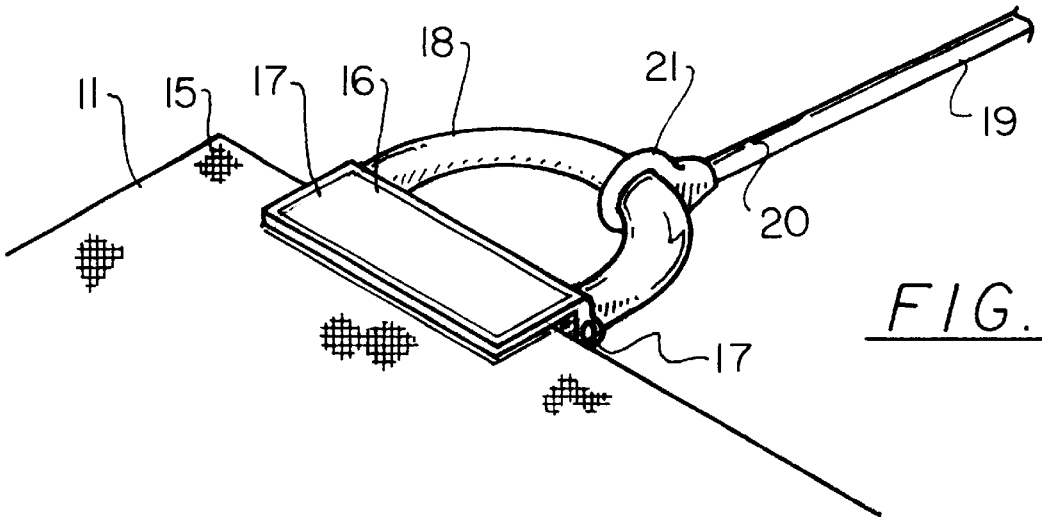
FIG. 6 is a partial perspective view of the present invention shown in use.
Figure 7:
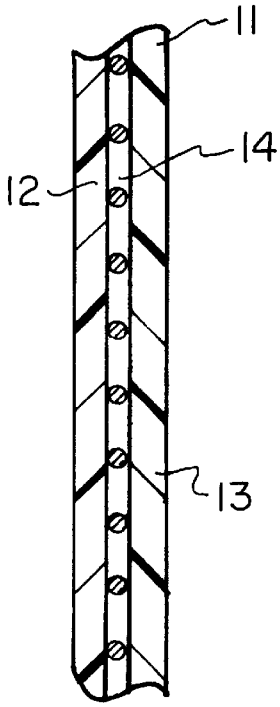
FIG. 7 is a cross-sectional view of the sheeting material of the present invention.

With reference now to the drawings, and in particular to FIGS. 1 through 7 thereof, a new shingle roofing and removing system embodying the principles and concepts of the present invention and generally designated by the reference numeral 10 will be described.

As best illustrated in FIGS. 1 through 7, the shingle roofing and removing system 10 generally comprises sheeting material 11 adapted to be securely and conventionally attached upon a roof 25 from a bottom edge to a top thereof and being adapted to be disposed beneath shingles 27 which are securely and conventionally attached to the sheeting material 11. The sheeting material 11 includes a pair of outer layers 12,13 and an inner layer 14 sandwiched between the outer layers 12,13. The outer layers 12,13 are essentially made of plastic, and the inner layer 14 is essentially made of a metallic mesh. The sheeting material 11 includes an end portion 15 which is adapted to extend above a crown 26 of the roof 25 with the end portion 15 being folded over upon the sheeting material 11 and being adapted to be securely and conventionally disposed upon the crown 26 of the roof 25. The end portion 15 has a width of approximately 4 to 5 inches.

Means for removing the sheeting material 11 along with the shingles 27 from the roof 25 includes a plurality of clamping members 16; a plurality of clamping support members 18 each of which is securely and conventionally attached to a respective clamping member 16; a plurality of secondary cable members 19 each having an end 20 and an eyelet 21 securely and conventionally attached to the end 20 and being securely and conventionally connected to a respective clamping support member 18; a cable support member 22 being securely and conventionally attached to the secondary cable members 19; a main cable member 23 being securely and conventionally attached to the cable support member 22; and a winch member 24 conventionally carrying the main cable member 23 thereabout for actuating removal of the sheeting material 11 and the shingles 27 from the roof 25 by taking up the main cable member 23. Each of the clamping members 16 includes jaw-like members 17 being clampable about the end portion 15 of the sheeting material 11 with the clamping members 16 being spaced approximately every 2 feet along the end portion 15 of the sheeting material 11. Each of the clamping support members 18 is essentially a ring having ends which are securely and conventionally attached to a respective clamping member 16. The winch member 24 is adapted to pull the secondary cable members 19 and the clamping members 16 along a roof 25 from a top to a bottom thereof to essentially remove the sheeting material 11 and the shingles 27 from the roof 25.

In use, the sheeting material 11 is secured with nails to a bare roof 25 with the end portion 15 being folded over and being securely disposed upon the crown 26 of the roof 25 with the shingles 27 being securely nailed to the sheeting material 11. Upon removal of the sheeting material 11 and the shingles 27, the user simply clamps the clamping members 16 every two feet along the end portion 15 of the sheeting material 11 and energizes the conventional winch member 24 which takes up the main cable member 23 and essentially pulls the clamping members 16 and the sheeting material 11 off the roof 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A shingle roofing and removing system comprising:

sheeting material adapted to be securely attached upon a roof from a bottom edge to a top thereof and being adapted to be disposed beneath shingles which are securely attached to said sheeting material;

means for removing said sheeting material along with the shingles from the roof;

wherein said sheeting material includes a pair of outer layers and an inner layer sandwiched between said outer layers;

wherein said outer layers are essentially made of plastic, and said inner layer is essentially made of metallic mesh;

wherein said sheeting material includes an end portion which is adapted to extend above a crown of the roof, said end portion being folded over upon said sheeting material and being adapted to be securely disposed upon the crown of the roof; and wherein said means for removing said sheeting material and the shingles from the roof includes a plurality of clamping members; a plurality of clamping support members each of which is securely attached to a respective said clamping member; a plurality of secondary cable members each having an end securely connected to a respective said clamping support member; a cable support member being securely attached to said secondary cable members; a main cable member being securely attached to said cable support member; and a winch member carrying said main cable member thereabout for actuating removal of said sheeting material and the shingles from the roof by taking up said main cable member.

2. A shingle roofing and removing system as described in claim 1, wherein each of said clamping members includes jaw-like members being clampable about said end portion of said sheeting material, said clamping members being spaced along said end portion of said sheeting material.

3. A shingle roofing and removing system as described in claim 1, wherein each of said clamping support members is essentially a ring having ends which are securely attached to a respective said clamping member.

4. A shingle roofing and removing system as described in claim 1, wherein said winch member is adapted to pull said secondary cable members and said clamping members along a roof from a top to a bottom thereof to essentially remove said sheeting material and the shingles from the roof.

5. A shingle roofing and removing system comprising:

sheeting material adapted to be securely attached upon a roof from a bottom edge to a top thereof and being adapted to be disposed beneath shingles which are securely attached to said sheeting material, said sheeting material including a pair of outer layers and an inner layer sandwiched between said outer layers, said outer layers being essentially made of plastic, and said inner layer being essentially made of metallic mesh, said sheeting material including an end portion which is adapted to extend above a crown of the roof, said end portion being folded over upon said sheeting material and being adapted to be securely disposed upon the crown of the roof, said end portion having a width of approximately 4 to 5 inches; and means for removing said sheeting material along with the shingles from the roof including a plurality of clamping members; a plurality of clamping support members each of which is securely attached to a respective said clamping member; a plurality of secondary cable members each having an end securely connected to a respective said clamping support member; a cable support member being securely attached to said secondary cable members; a main cable member being securely attached to said cable support member; and a winch member carrying said main cable member thereabout for actuating removal of said sheeting material and the shingles from the roof by taking up said main cable member, each of said clamping members including jaw-like members being clampable about said end portion of said sheeting material, said clamping members being spaced approximately every 2 feet along said end portion of said sheeting material, each of said clamping support members being essentially a ring having ends which are securely attached to a respective said clamping member, said winch member being adapted to pull said secondary cable members and said clamping members along a roof from a top to a bottom thereof to essentially remove said sheeting material and the shingles from the roof.

6. A shingle roofing and removing system comprising:

sheeting material adapted to be securely attached upon a roof from a bottom edge to a top thereof and being adapted to be disposed beneath shingles which are securely attached to said sheeting material; and means for removing said sheeting material along with the shingles from the roof including a plurality of clamping members; a plurality of clamping support members each of which is securely attached to a respective said clamping member; a plurality of secondary cable members each having an end securely connected to a respective said clamping support member; a cable support member being securely attached to said secondary cable members; a main cable member being securely attached to said cable support member; and a winch member carrying said main cable member thereabout for actuating removal of said sheeting material and the shingles from the roof by taking up said main cable member.

7. A shingle roofing and removing system as described in claim 6, wherein said sheeting material includes a pair of outer layers and an inner layer sandwiched between said outer layers.

8. A shingle roofing and removing system as described in claim 7, wherein said outer layers are essentially made of plastic, and said inner layer is essentially made of metallic mesh.

9. A shingle roofing and removing system as described in claim 6, wherein said sheeting material includes an end portion which is adapted to extend above a crown of the roof, said end portion being folded over upon said sheeting material and being adapted to be securely disposed upon the crown of the roof.

10. A shingle roofing and removing system as described in claim 6, wherein each of said clamping members includes jaw-like members being clampable about said end portion of said sheeting material, said clamping members being spaced along said end portion of said sheeting material.

11. A shingle roofing and removing system as described in claim 6, wherein each of said clamping support members is essentially a ring having ends which are securely attached to a respective said clamping member.

12. A shingle roofing and removing system as described in claim 6, wherein said winch member is adapted to pull said secondary cable members and said clamping members along a roof from a top to a bottom thereof to essentially remove said sheeting material and the shingles from the roof.

* * * * *